United States Patent [19]

Grey

[11] Patent Number: 4,710,040

[45] Date of Patent: Dec. 1, 1987

[54] PRINTER HAVING CONSTANT PRESSURE BETWEEN PRINT HEAD AND PLATEN

[75] Inventor: Michael O. Grey, Ithaca, N.Y.

[73] Assignee: NCR Corporation, Dayton, Ohio

[21] Appl. No.: 804,019

[22] Filed: Dec. 2, 1985

[51] Int. Cl.[4] ..... B41J 11/20; B41J 3/04

[52] U.S. Cl. ..... 400/55; 400/120; 101/93.03; 346/76 PH; 219/216

[58] Field of Search ..... 400/55, 56, 57, 59, 400/120, 124, 335, 660, 660.1, 660.2, 53; 15/103, 250.3, 250.34, 250.35; 101/93.03, 94; 346/76 PH; 219/216

[56] References Cited

U.S. PATENT DOCUMENTS

| | | | |
|---|---|---|---|
| 2,142,054 | 12/1938 | Horton | 15/250.34 |
| 2,226,358 | 12/1940 | Sibley | 15/250.35 |
| 3,990,560 | 11/1976 | Pavliscak et al. | 197/1 R |
| 4,010,834 | 3/1977 | Linder | 400/55 X |
| 4,170,422 | 10/1979 | Bilek | 400/120 |
| 4,170,804 | 10/1979 | Scotcher | 15/250.34 |
| 4,184,063 | 1/1980 | Heiling et al. | 219/216 |
| 4,277,189 | 7/1981 | Howard et al. | 400/55 X |
| 4,300,844 | 11/1981 | Keil | 400/120 |

FOREIGN PATENT DOCUMENTS

| | | | |
|---|---|---|---|
| 193912 | 6/1986 | Fed. Rep. of Germany | 400/120 |

OTHER PUBLICATIONS

IBM Tech. Disc. Bulletin, "Thermal Print Head Control", Perry, vol. 21, No. 4, Sep. 1978, pp. 1594–1595.

IBM Tech. Disc. Bulletin, "Molded Platen Shaft Bearing Assembly for Office Printers and Typewriters", Olson et al., vol. 25, No. 7B, Dec. 1982, pp. 3863–3864.

IBM Tech. Disc. Bulletin, "Deflectable Wedge-Type, Permanent Tractor Belt Tensioner", Koteff, vol. 27, No. 3, Aug. 1984, pp. 1617–1618.

IBM Tech. Disc. Bulletin, "Securing Element for Axles and Shafts", vol. 27, No. 12, May 1985, pp. 7063–7064.

*Primary Examiner*—Charles A. Pearson

*Assistant Examiner*—James R. McDaniel

*Attorney, Agent, or Firm*—Wilbert Hawk, Jr.; Albert L. Sessler, Jr.; Elmer Wargo

[57] ABSTRACT

A non-impact printer having a biasing mechanism which provides for constant and self-adjusting pressure between the associated print head and platen. The biasing mechanism includes a base member, a pivoting member, and a biasing member. The biasing mechanism has one end which slides longitudinally in an aperture in the pivoting member which is pivotally mounted in the base member which is secured to the frame of the printer, and the remaining end of the biasing member is pivotally jointed to the associated carriage of the printer to move the carriage with the print head thereon into printing relationship with the platen.

1 Claim, 9 Drawing Figures

10
48
50
40
PLATEN DRIVE
72
38
70-1
52
PLATEN SUPPORT
12
14
42
SUPPORT
20
30
A
26
24
16
70
94
62
66
92
TO PRINT HEAD-32
REVERSIBLE STEPPING DRIVE
22
28
CONTROLLER
64
88
PAPER SUPPLY
54
18
29
INPUT
RIBBON SUPPLY
56

PRINTER HAVING CONSTANT PRESSURE BETWEEN PRINT HEAD AND PLATEN

BACKGROUND OF THE INVENTION

This invention relates to a printer, and more particularly, it relates to a printer having a constant and self-adjusting pressure between the associated print head and platen. A preferred embodiment of this invention is shown in a non-impact printer environment.

Non-impact-type print heads are moved, generally, across a printing medium in order to form characters in a step-by-step fashion. As the print head itself gets wider as measured along the length of the platen, slight variations in the diameter of the platen or thickness of the associated ribbons or paper may cause portions of the print head to fully contact the print medium at one area and barely contact the print medium at other areas. This results in uneven or poor printing.

Some of the prior art techniques for overcoming the problem mentioned involve utilizing expensive, carefully-machined platens, spring-loaded pinch rollers, or special pivoting devices, for example.

SUMMARY OF THE INVENTION

In contrast with the prior art techniques mentioned, the present invention is low cost, easy to install, provides constant pressure between the associated print head and platen, and is self-adjusting to compensate for various carriage positions and media thicknesses.

A preferred embodiment of this invention, when incorporated into a printing environment, comprises: a frame; a platen having a longitudinal axis; a print station; means for feeding printing media to the print station; a carriage having a print head thereon and means for moving the carriage with the print head thereon in reciprocating movement parallel to the longitudinal axis of the platen and relative to the print station; and means for biasing the print head towards the platen. The means for biasing the print head towards the platen comprises: at least one biasing member having first and second ends with the first end having an offset portion which is pivotally mounted in the carriage so as to bias the print head into printing relationship with the printing media at the print station; and mounting means secured to the carriage to slidably receive the second end of the biasing member for movement in a plane and to enable the second end to be pivoted about an axis which is substantially perpendicular to said plane as the carriage is moved.

The advantages mentioned, and others, will become more readily apparent upon reviewing the following specifications, claims, and drawing.

DETAILED DESCRIPTION OF THE INVENTION

Figure 1:
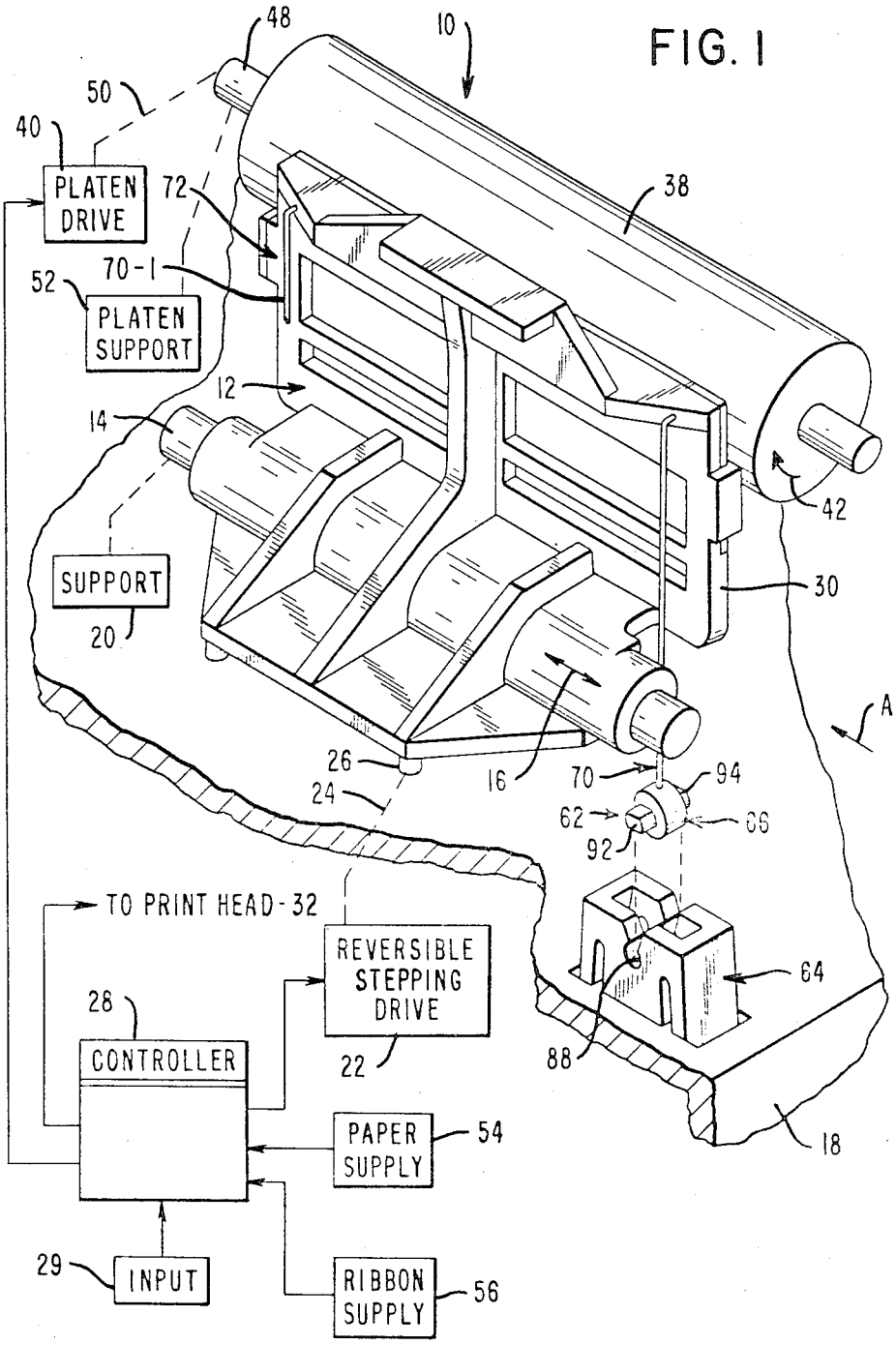
FIG. 1 is a general exploded view, in perspective, to show a preferred embodiment of a non-impact type printer in which this invention may be used, with certain known elements being shown in schematic or block form to simplify the drawing.

FIG. 1 is a general exploded view in perspective, of a printer 10 in which a preferred embodiment of this invention is shown. The printer 10 includes a carriage, designated generally as 12, which is slidably mounted on the round rod 14 for reciprocating movement in the directions of double arrow 16. The means for supporting the rod 14 on the base 18 of the printer is conventional and is shown only schematically as support 20. The means for moving the carriage 12 in reciprocating movement along the rod 14 is conventional as is shown schematically as a reversible stepping drive 22. The stepping drive 22 may include a reversible rotary stepping motor (not shown), timing disc, and conventional translational linkage (shown as dashed line 24) coupled to the lug 26 which depends from the carriage 12. The reversible stepping drive 22 is under the control of the controller 28, and the linkage 24 converts the bi-directional, rotary motion of the stepping motor in the drive 22 into the bidirectional, linear motion represented by double arrow 16.

Figure 2:
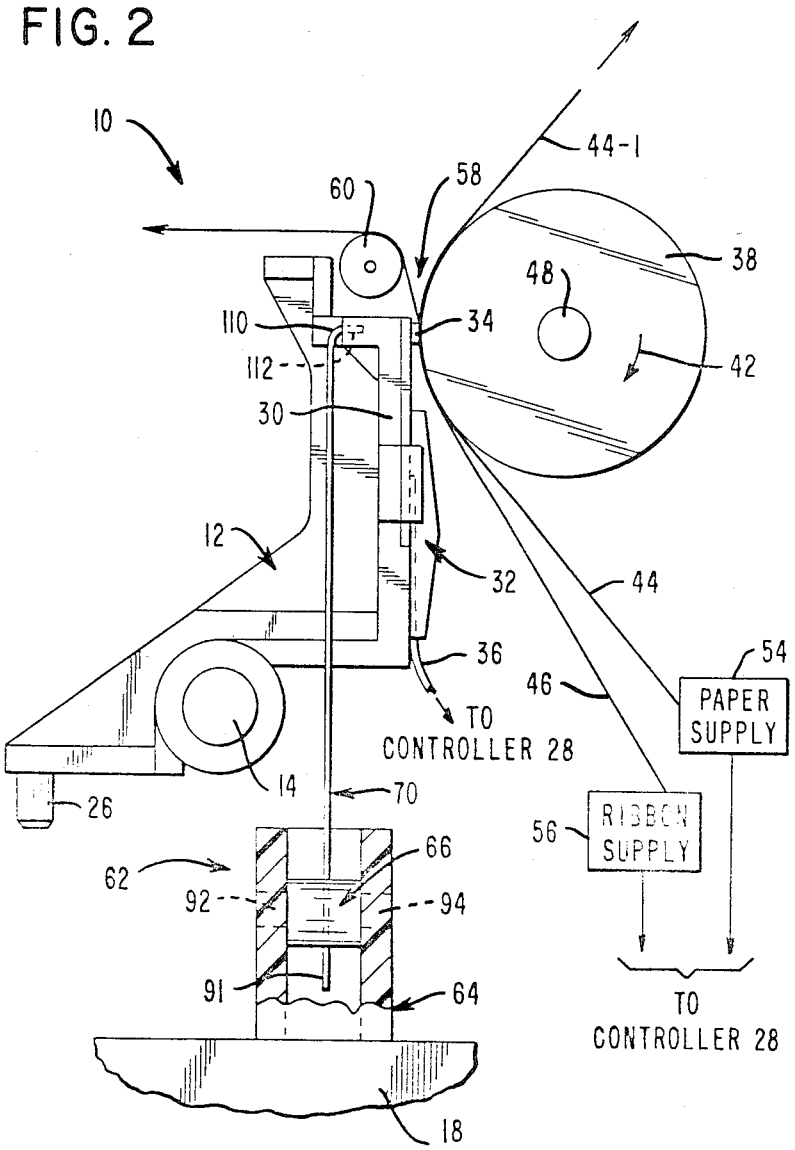
FIG. 2 is a side view, in elevation, which is taken along the direction of arrow A in FIG. 1 to show additional details of the printer shown in FIG. 1.

The carriage 12 (FIGS. 1 and 2) also contains a support structure 30 on which a thermal print head, designated generally as 32 (FIG. 2), is mounted. The print head 32 contains a row of selectively-energizable, electrically-operated, heating elements 34 (shown in exaggerated size in FIG. 2) and their associated, multi-stranded, energizing cable 36 which is coupled to the controller 28. In the embodiment described, printing is effected by selectively energizing the spaced, heating elements 34 in a row to begin the formation of characters to be printed on a line along the platen 38. In this regard, the controller 28 receives the input 29 to be printed and formats the input into the appropriate energizing patterns making up the matrix-type characters to be printed. Thereafter, the stepping drive 22 is energized to move the carriage 12 and print head 32 thereon one heating-element position along the length of the platen 38 to further complete the formation of characters on a line along the platen 38. After a predetermined number of indexes along the platen 38 as just described, the controller 28 energizes the platen drive 40 causing the platen 38 to be incrementally indexed one position in the direction of arrow 42 (FIG. 2). Thereafter, printing along the row of printing elements 34 is effected as described, however, the stepping drive 22 moves the carriage 12 in the opposite direction from that described in example under discussion. In the embodiment described, the lateral movement of the carriage 12 along the directions of double arrow 16 amounts to approximately one-half inch. Also, in the embodiment described, seven indexes of the platen 38, with the paper 44 and inked ribbon 46 thereon, are necessary to complete the "height" of a matrix-type character. Correspondingly, five indexes by the stepping drive 22 along the platen 38 are necessary to complete the "width" of a character being printed. The stepping drive 22 may include a D.C. motor with a timing disc (not shown) to effect the indexing. Naturally, other matrices such as forming characters by a 7 by 9 matrix may be used.

Because this aspect of the printing is conventional, it need not be discussed in any further detail.

The platen drive 40 (FIG. 1) contains a stepping motor (not shown) which is used to index the platen 38 as just described. The platen drive 40 is coupled to the shaft 48 (to index it) by conventional driving linkage shown only as dashed line 50. The shaft 48 of the platen 38 is supported in the position shown by conventional support structure shown only schematically as platen support 52.

The printing media associated with the printer 10 include the paper supply 54 and the ribbon supply 56 which are shown only in schematic form in FIGS. 1 and 2. The paper supply 54 and the ribbon supply 56 may have "out-of-supply" sensors (not shown) which are connected to the controller 28 to inform the controller 28 of the need to stop the printing operation when the printer 10 is short of or out of paper 44 or ribbon 46. In the embodiment described, the platen 38 moves the paper 44 and ribbon 46 to the print station shown generally by arrow 58. After printing, the ribbon 46 passes over a separating roller 60 to a wind-up roller, for example, (not shown) where the used ribbon is collected. The paper with printing thereon (shown as 44-1) may then be removed from the printer 10.

Figure 6:
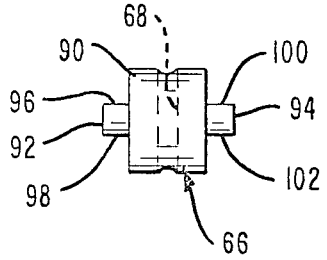
FIGS. 6, 7, and 8 are side, end, and plan views, respectively, of a pivoting member which is part of the means for biasing the print head towards the platen.
Figure 7:
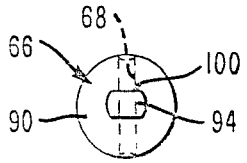
Figure 8:
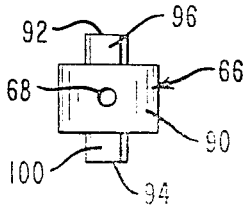

The printer 10 also includes the means for biasing the carriage 12 with the print head 32 thereon towards the platen 38 as alluded to earlier herein; this biasing means, which is designated generally as 62, is shown in general, exploded perspective view in FIG. 1 and is shown in assembled relationship in FIG. 2. The biasing means 62 includes: the base member 64 which is secured to the base plate 18, a pivoting member 66 (FIGS. 6–8) having a through hole 68 therein, and a cantilever-type, biasing member 70. The printer 10 also includes a second biasing means 72 which is identical to the biasing means 62; however, only the associated cantilever-type, biasing member 70-1 of the biasing means 72 is shown in FIG. 1 to simplify the drawing.

Figure 3:
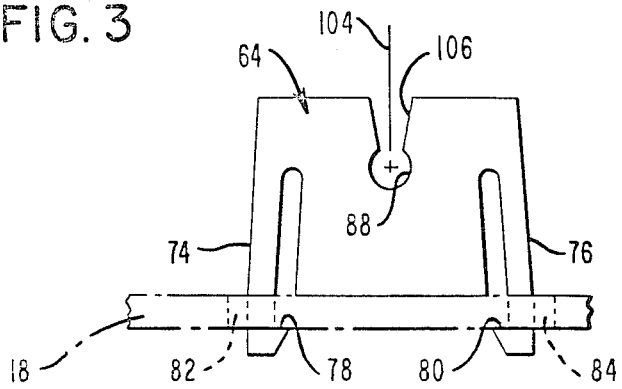
FIGS. 3, 4, and 5 are front, top, and side views, respectively, of a base member associated with a means for biasing the print head of the printer towards the platen shown in FIG. 1.
Figure 4:
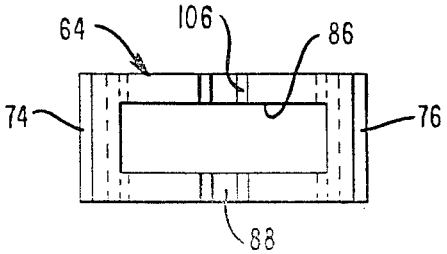
Figure 5:
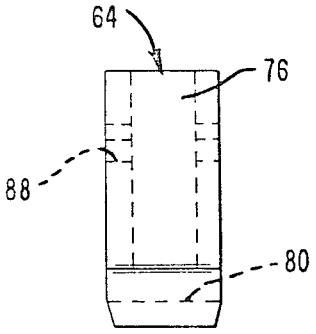

The base member 64 is shown in more detail in FIGS. 3, 4, and 5. The base member 6 has slightly-expandable legs 74 and 76 with abutment shoulders 78 and 80, respectively, thereon to fit into holes 82 and 84 in the base 18 to enable the base member 64 to be detachably secured to the base 18 (shown in dashed outline in FIG. 3). The base member 64 also has a quadrilaterally-shaped recess 86 therein (FIG. 4) and an arcuately-shaped recess 88 (FIG. 3) therein which is generally "C"-shaped or open at the top to receive pivoting member 66 shown in detail in FIGS. 6, 7, and 8.

The pivoting member 66 (FIGS. 6–8) has a cylindrically-shaped, body portion 90 having the radially-aligned hole 68 therein to slidably receive an end portion 91 (FIG. 9) of the cantilever-type, biasing member 70. The pivoting member 66 also has cylindrical projections 92 and 94 which extend from opposed sides of the body portion 90 and have longitudinal axes which are coincident with the longitudinal axis of the body portion 90. In addition, the cylindrical projections 92 and 94 are dimensioned to pivot or rotate within the arcuately-shaped recess 88 of the base member 64, and these projections 92 and 94 have portions removed to produce the flat areas 96 and 98 (FIG. 6) on projection 92 and the flat areas 100 and 102 on projection 94. The aperture or hole 68 in the pivoting member 66 has an axis which is substantially perpendicular to a plane including at least one of the flat areas 96, 98, 100, or 102. The pivoting member 66 is inserted into the base member 64 by aligning the flat areas 96, 98, 100 and 102 so as to be parallel to the dashed line 104 (FIG. 3) and thereafter, the pivoting member 66 is pushed downwardly (as viewed in FIG. 3). After the projections 92 and 94 are in the arcuately-shaped recess 88, the pivoting member 66 is rotated about ninety degrees to thereby retain the pivoting member 66 in the base member 64 and to position the hole 68 in a substantially vertical position to receive the biasing member 70 as shown in FIG. 1. The base member 64 has a tapered entrance 106 (FIG. 3) whose narrowest portion is dimensioned to permit the flat areas 100 and 102, for example, to pass therethrough prior to the cylindrical projections 92 and 94 being rotatably seated in recess 88. When the biasing means 62 is in the assembled relationship in FIG. 2, the longitudinal axis of the pivoting member 66 is substantially perpendicular to a vertical plane which includes the longitudinal axis of rod 14 and is also perpendicular to base 18. In other words, the end portion 91 of the biasing member 70 moves in a plane which is perpendicular to the longitudinal axis of the pivoting member 66.

Figure 9:
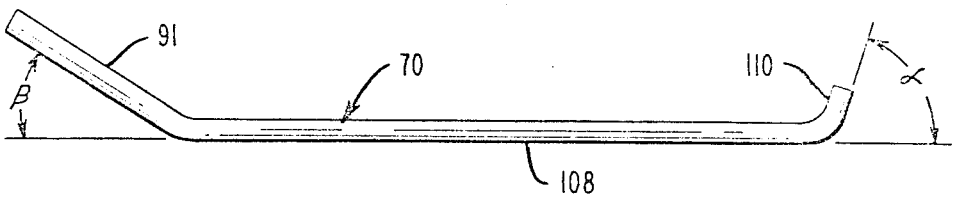
FIG. 9 is a plan view of the cantilever-type, biasing member shown in FIGS. 1 and 2.

The means 62 for biasing the print head 32 towards the platen 38 also includes the cantilever-type, biasing member 70, alluded to earlier herein and shown in more detail in FIG. 9. The biasing member 70 has the end portion 91 which slides in the pivot member 66 (FIG. 1), a central body portion 108, and it also has a second end portion 110. The end portion 110 is offset or angled from the central body portion 108 by an angle alpha ($\alpha$) of about 72 degrees in the embodiment described. The end portion 91 is offset from the central body portion 108 by an angle Beta ($\beta$) of approximately 32 degrees in the embodiment described. Both of these end portions 91 and 110 and the body portion 108 lie in the same plane to enable the biasing member 70 to apply its biasing force to move the print head 32 towards the platen 38.

After the pivoting member 66 (FIG. 1) of the biasing means 62 is installed in the base portion 64 as previously described, the end portion 91 of biasing lever 70 is inserted into the hole 68 of the pivoting member 66. Then, the biasing lever 70 is turned so that the end portion 110 is aligned with the receiving hole 112 (FIG. 2) in the carriage 12 and is inserted therein. Installing the biasing member 70 in the manner described causes the angle beta ($\beta$) of the biasing member 70 to be reduced towards zero degrees, thereby applying a biasing force to move the print head 32 into printing relationship with the ribbon 46, paper 44, and platen 38 at the print station 56 (FIG. 2). As the carriage 12 is moved forwards and backwards by the reversible stepping drive 22 during the act of printing, the end portion 110 of the biasing lever 70 pivots within the hole 112 (FIG. 2), and the other end 91 slides longitudinally within the pivoting member 66. As the carriage 12 moves to the left and right as viewed in FIG. 1, the lower end 91 of the biasing lever 70 also pivots (via the pivoting member 66) relative to the base member 64.

In the embodiment described, the base member 64 and the pivoting member 66 may be made of an acetal plastic material like "Delrin 500" which is a trademark of E. I. Dupont de Nemours and Company, or they may be made of a porous, self-lubricating, bronze metal, for example. The biasing member 70 may be made of steel music wire having a nominal diameter of 0.060 inch. The biasing means 72 (FIG. 1) is identical to the biasing means 62 already described.

The means 62, 72 for biasing the printing head 32 towards the platen is adjustable, for example, in the following ways:

1. The base member 64 can be located closer to or farther away from the platen 38 to increase or decrease pressure on the platen 38.

2. The diameter, the length of the ends 91 and 110, the offset angles of ends 91 and 110, and the material of the biasing member 70 can be varied to alter the pressure on the platen 38.

3. As a fine-tuning adjustment, after the end portion 110 of the biasing member 70 is installed in the hole 112 (FIG. 2) and abuts against the bottom of the hole 112, the end portion 110 may pulled out of the hole 112 and its length reduced by cutting a portion off so as to reduce the pressure of the print head 32 against the platen. As printing media (ribbon 46 and paper 44) of different thicknesses are used, the biasing means 62 adjusts to the different thicknesses utilized. In the embodiment described, the print head 32 is a thermal printer.

What is claimed is:

1. A printer comprising:

a frame;

a platen mounted on said frame and having a longitudinal axis;

a print station;

means for feeding printing media to said print station;

a carriage mounted on said frame and having a print head thereon, and means for moving said carriage with said print head thereon in reciprocating movement parallel to the longitudinal axis of said platen and relative to said print station; and means for biasing said print head towards said platen comprising:

at least one biasing member having first and second end portions;

said first end portion having an offset portion which is pivotally mounted in said carriage so as to bias said print head into printing relationship with the printing media at said print station; and mounting means secured to said frame to slidably receive said second end portion of said biasing member for sliding movement in a plane and to enable said second end portion to be pivoted about a pivoting axis which is substantially perpendicular to said plane as said carriage is moved;

said biasing member having a central portion with said first and second end portions being joined to said central portion;

said second end portion being offset at an angle relative to said central portion; and said first and second end portions and said central portion lying in a common plane, with said first and second end portions being located on the same side of said central portion;

said mounting means comprising a base member secured to said frame and a pivoting member pivotally mounted in said base member to pivot about said pivoting axis;

said pivoting member having an aperture therein to slidably receive said second end portion of said biasing member for said sliding movement in said plane;

said base member having an opening therein which leads to an arcuately-shaped recess therein;

said pivoting member having aligned, cylindrical projections extending from opposed sides thereof, with said cylindrical projections having portions removed to produce flat areas thereon to enable said pivoting member to pass through said opening in said base member and to be retained in said arcuately-shaped recess upon an approximately ninety-degree rotation of pivoting member; and said aperture in said pivoting member being substantially perpendicular to a plane including at least one of said flat areas on said cylindrical projections.

* * * * *